US005884815A

United States Patent [19]

Stolz

[11] Patent Number: 5,884,815

[45] **Date of Patent: *Mar. 23, 1999**

[54] SAFETY CLOSURE FOR A CONTAINER COMPRISING A CLOSURE LOWER MEMBER AND A SCREW CAP

[75] Inventor: Bernd Stolz, Neunkirchen, Germany

[73] Assignee: Heinrich Stolz GmbH & Co. KG, Neunkirchen, Germany

[ * ] Notice: The term of this patent shall not extend beyond the expiration date of Pat. No. 5,526,947.

[21] Appl. No.: 676,391

[22] PCT Filed: Apr. 7, 1995

[86] PCT No.: PCT/EP95/01292

§ 371 Date: Dec. 9, 1996

§ 102(e) Date: Dec. 9, 1996

[87] PCT Pub. No.: WO95/27663

PCT Pub. Date: Oct. 19, 1995

[30] Foreign Application Priority Data

| | | | |
|---|---|---|---|
| Apr. 8, 1994 | [DE] | Germany | 44 12 195.4 |
| Dec. 31, 1994 | [DE] | Germany | G 9420952 U |
| Jan. 26, 1995 | [DE] | Germany | 295 01 185.8 |

[51] Int. Cl.[6] ..... B67D 5/33

[52] U.S. Cl. ..... 222/153.14; 215/204; 215/211; 215/213; 215/216; 215/217; 215/221; 215/334; 220/281; 222/541.9

[58] Field of Search ..... 215/44, 43, 204, 215/211, 213, 216–221, 330, 334, 331; 220/281; 222/153.14, 153.07, 541.9

[56] References Cited

U.S. PATENT DOCUMENTS

| | | | |
|---|---|---|---|
| 3,623,622 | 11/1971 | Sullivan | 215/213 |
| 3,939,788 | 2/1976 | Schneible | 215/213 X |
| 4,098,418 | 7/1978 | Fields | 220/281 X |
| 4,413,743 | 11/1983 | Summers | 215/216 |
| 4,444,326 | 4/1984 | Musel | 215/209 |
| 5,078,288 | 1/1992 | Fuchs | 215/209 |
| 5,230,433 | 7/1993 | Hamilton | 215/221 |
| 5,238,130 | 8/1993 | Marques et al. | 215/211 X |
| 5,526,947 | 6/1996 | Stolz | 215/218 X |
| 5,566,864 | 10/1996 | Stolz | 222/153.14 |
| 5,685,445 | 11/1997 | Dobbs | 215/330 |

FOREIGN PATENT DOCUMENTS

| | | |
|---|---|---|
| 0264152 | 4/1988 | European Pat. Off. . |
| 3625477 | 2/1988 | Germany . |
| 4139896 | 6/1993 | Germany . |
| 4209784 | 9/1993 | Germany . |

*Primary Examiner*—Stephen K. Cronin
*Assistant Examiner*—Robin Hylton
*Attorney, Agent, or Firm*—Speckman Pauley Peterson & Fejer

[57] ABSTRACT

A closure for a container having a closure lower member and a screw cap in which the closure lower member is connectable with a base member to the container aperture. The closure lower member has a pouring spout connected to the base member. The screw cap has a cap bottom and a cap side wall with an internal thread adapted to be screwed onto and unscrewed from the pouring spout which has an external thread. The cap side wall of the screw cap in a region of its free end face terminates in at least one latching lug, the latching lugs of the screw cap co-operating with latching projections of the closure lower member to form a latch connection. In a screwing on direction the closure lower member has a shallow rising flank which merges into a steep latching flank and also forms the latching connection with the latching lugs, the connection being reversible by displacement of the latching lugs in relation to the latching projections. A child protection means can easily be canceled because the closure lower member has an annular flange molded on, which projects towards the cap side wall, overlapping the latching lugs at least partly, and the annular flange carries latching projections on the inside which faces the latching lugs.

8 Claims, 1 Drawing Sheet

SAFETY CLOSURE FOR A CONTAINER COMPRISING A CLOSURE LOWER MEMBER AND A SCREW CAP

BACKGROUND OF THE INVENTION

1. Field of the Invention

This invention relates to a closure for a container with a closure lower member and a screw cap in which the closure lower member is connectable by a base member to the container aperture and includes a pouring spout which is connected to the base member. The screw cap has a cap bottom and a cap side wall with an internal thread that is adapted to be screwed onto and unscrewed from the pouring spout which has an external thread. The cap side wall of the screw cap in the region of its free end face terminates in at least one latching lug, the latching lugs of the screw cap co-operating with latching projections of the closure member to form a latch connection. In a screwing on direction a shallowly rising flank merges into a steep latching flank and forms the latching connection with the latching lugs, the connection being reversible by displacement of the latching lugs relative to the latching projections.

2. Description of Prior Art

A conventional closure is known from German Patent Reference DE 42 09 784 A1. In this known closure the latching connection is formed between the screw cap and the bellows. For that purpose the end face of the cap walls has circumferential latching recesses into which latching projections molded onto the bellows of the closure lower member engage. In order to undo the latching connection the bellows must be compressed so that the latching projections are radially deflected inwardly and are disengaged from the latching rebates in the cap side wall. This deflection of the bellows requires considerable application of force, particularly in the case of a strong closure for large containers.

A need exists for latching connections in a closure of the type referred to above, that can be opened easily without, however, losing its function as a child protection means.

SUMMARY OF THE INVENTION

This invention provides a closure as set out above, wherein at the closure lower member an annular flange is molded on, which projects towards the cap side wall, overlapping the latching lugs at least partly, and wherein the annular flange carries latching projections on the inside which faces the latching lugs.

The latching lugs can be pressed inwardly outside of the annular flange, such that the latch connection with the latching projection on the inside of the annular flange is undone. Accordingly, the latching lugs of the screw cap can pass the latching flanks of the latching projections, that is the screw cap can be unscrewed from the pouring spout. The positions of the latching lugs are easily detected so that adults experience no difficulties in canceling the child protection function. Due to the additional annular flange on the closure lower member the function of the bellows is not interfered with as is the case with the known closure, where the latching projections are on the bellows.

In one preferred embodiment of this invention, a resilient annular flange may be provided. The annular flange can be deformed to an oval shape by compression. This results in a cancellation of the latching connection to release the screw cap.

According to another preferred embodiment of this invention, the annular flange comprises tooth formations including multiple successively arranged latching projections. The latching projections follow each other equidistantly and the latching lugs have one or more co-acting latching elements which enter into the latching connection with the latching projections.

In another preferred embodiment of this invention, the cap side wall has two latching lugs diametrically opposed and each latching lug is associated with a latching projection on the closure member. By compression of the lower region of the cap side wall both latching connections are canceled simultaneously if pressure points on the screw cap are at the latching lugs. The screw cap when gripped and compressed may then simultaneously also be unscrewed off the pouring spout.

The application of the annular flange to the closure lower member is preferably designed to that the pouring spout is molded onto the closure lower member by way of a shoulder and so that the annular flange is molded concentrically to the pouring spout onto the shoulder and thereby forms with the spout an annular recess for accommodating the latching lugs of the screw cap.

In order for ease of deflection of the latching lugs, in a further embodiment the latching lugs are of thin-walled design and extend over a portion of the circumference of the cap side wall and are easily radially deflectable. In that manner an enlarged region of attack for gripping the screw cap is attained.

BRIEF DESCRIPTION OF THE DRAWING

This invention will be further explained with reference to a working example illustrated in the drawing wherein.

DESCRIPTION OF PREFERRED EMBODIMENTS

Figure 1:
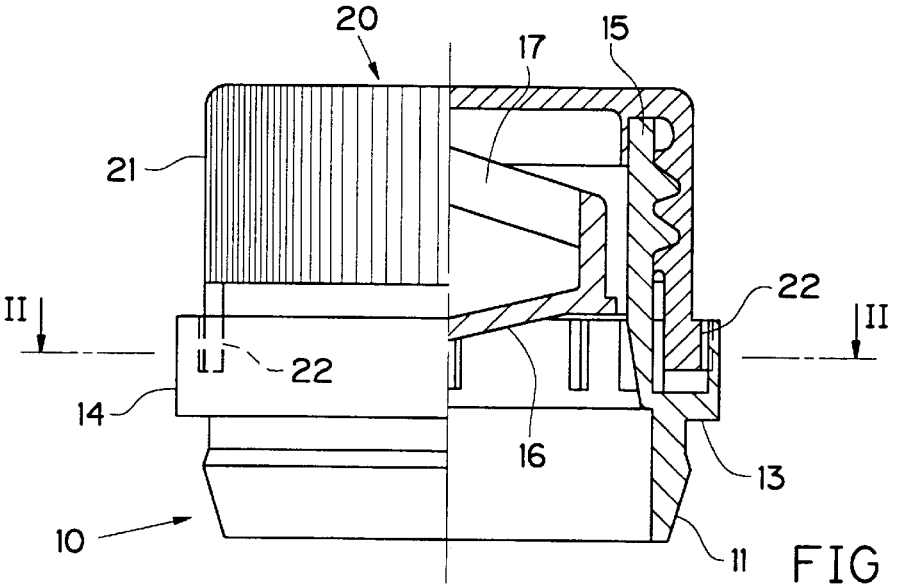
FIG. 1 is a partial cross-sectional view of a closure having a closure lower member and a screw cap in a secured closing position.

The closure according to one preferred embodiment of this invention comprises a closure lower member 10 which includes a base member 11 and a pouring spout 15. The base member 11 is adapted to be snap fitted into a container aperture. The pouring spout 15 includes an external thread onto which a screw cap 20 having an internal thread can be screwed and be unscrewed. The screw cap 20 bears the internal thread on the inside of a cap side wall 21. The pouring spout 15, in the condition in which it is shown in FIG. 1, is closed by a sealing disc 16. The sealing disc 16 can be ripped out of the pouring spout 15 by means of a gripping lug 17.

Figure 2:
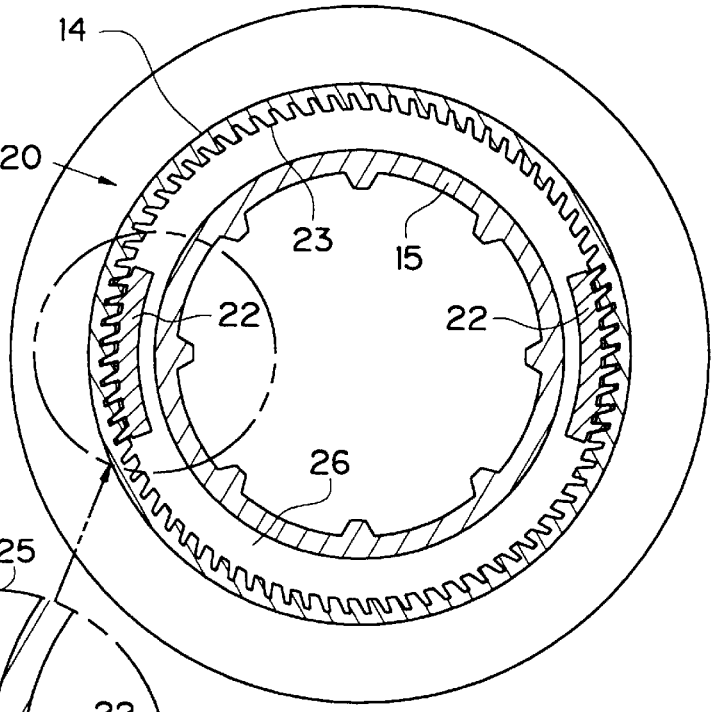
FIG. 2 is a cross-section taken along line II—II of FIG. 1.
Figure 3:
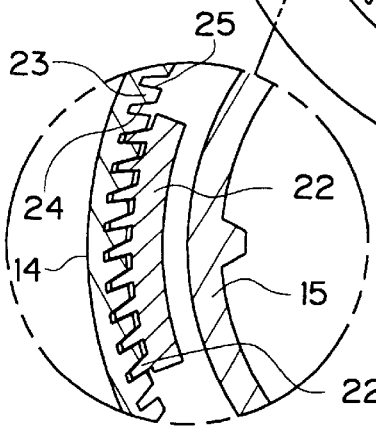
FIG. 3 is an enlarged view within the phantom lines as shown in FIG. 2.

The cap side wall 21 of the screw cap 20, at its free end phase, terminates in two diametrically opposite latching lugs 22 which extend over a portion of the circumference of the screw cap 20, as shown in FIG. 2. The transition from the pouring spout 15 to the closure lower member 10 is a shoulder 13. An annular flange 14 is molded onto the shoulder 13 directed towards the cap side wall 21 and together with the pouring spout 15 forms a cavity 26 for accommodating the latching lugs 22 of the screw cap 20 if the screw cap 20 is screwed onto the pouring spout 15. The annular flange 15 bears on an inside, facing the latching lugs 22, latching projections 23 which in the screwing on direction comprise shallow rising flanks 24. The shallow rising flanks 24 merge into steep latching flanks 25. The latching lugs 22 bear matching latch members 22*a*, as shown in more detail in FIG. 3. The matching latch members 22*a* are equidistantly spaced apart and are of tooth-shaped design. The matching latch members 22*a* latch into valleys formed between the latching projections 23. In order to prevent inadvertent unscrewing of the screw cap 20 the matching latch members 22*a* likewise comprise a steep latching flank which enters into engagement with the latching flanks 25 of the latching projections 23.

The latching projections 23 as such are provided as teeth equidistantly spaced over the entire circumference of the annular flange 14. This spacing corresponds to the spacing of the matching latch members 22*a*.

If the screw cap 20 is gripped in the region of the latching lugs 22 and is compressed, the latching lugs 22 become disengaged from the latching projections 23 on the annular flange 14. The screw cap 20 can then be unscrewed from the pouring spout 15.

When screwing the screw cap 20 onto the pouring spout 15, the matching latch members 22*a* of the latching lugs 22 slide over the shallow rising flanks 24 of the latching projections 23 on the annular flange 14.

As a rule a single latch connection will suffice for child protection. The two diametrically opposed latches that form the connection will increase, however, the reliability and facilitate the cancellation of the child protection by adults.

The claims which follow are to be considered an integral part of the present disclosure. Reference number corresponding to the drawings and inserted in the claims facilitate the correlation of numbers of the claims with illustrated features of the preferred embodiments, but are not intended to restrict in any way the language of the claims to what is shown in the drawings, unless the contrary is clearly apparent from the context.

I claim:

1. A closure for a container comprising: a closure lower member and a screw cap, the screw cap having a cap bottom and a cap side wall, the cap side wall having an internal thread engageable with an external thread of the lower member, the cap side wall in a region of a free end face terminating in at least one latching lug, the at least one latching lug co-operating with a latching projection of the closure lower member forming a latch connection, the closure lower member having in a screwing on direction a shallow rising flank merging into a steep latching flank and forming the latching connection with the at least one latching lug, the closure lower member (10) having a molded annular flange (14) projecting towards the cap side wall (21) and at least partly overlapping the at least one latching lug (22), and the annular flange (14) carrying the latching projection (23) facing the at least one latching lug (22).

2. A closure for a container comprising: a closure lower member and a screw cap, the closure lower member having a base member with connection means for connecting the closure lower member to a container aperture, a pouring spout connected to the base member, the screw cap having a cap bottom and a cap side wall, the cap side wall having an internal thread engageable with an external thread of the pouring spout, the cap side wall in a region of a free end face terminating in at least one latching lug, the at least one latching lug co-operating with a latching projection of the closure lower member forming a latch connection, the closure lower member having in a screwing on direction a shallow rising flank merging into a steep latching flank and forming the latching connection with the at least one latching lug, the closure lower member (10) having a molded annular flange (14) projecting towards the cap side wall (21) and overlapping the at least one latching lug (22) at least partly, and the annular flange (14) carrying a plurality of tooth formations successively arranged to form a plurality of latching projections (23) facing the at least one latching lug (22), each of the plurality of latching projections (23) being equidistantly spaced, and the at least one latching lug (22) including at least one co-acting latching element (22*a*) which enters into latching connection with at least one of the latching projections (23).

3. A closure according to claim 2, wherein the at least one co-acting latching element (22*a*) is mutually spaced apart by spacings corresponding to a plurality of spacings of the latching projections (23).

4. A closure according to claim 2, wherein on the cap side wall (21) two of the latching lugs (22) are positioned diametrically opposed and each of the latching lugs (22) is associated with one of the latching projections (23) on the closure lower member (10).

5. A closure according to claim 4, wherein the pouring spout (15) is molded onto the closure lower member (10) with a shoulder (13) and the annular flange (14) is molded concentrically to the pouring spout (15) onto the shoulder (13) and forms with the pouring spout (15) an annular recess (25) for accommodating the latching lugs (22) of the screw cap (20).

6. A closure according to claim 5, wherein the at least one latching lug (22) extends over a portion of a circumference of the cap side wall (21) and is radially deflectable.

7. A closure according to claim 2, wherein the pouring spout (15) is molded onto the closure lower member (10) with a shoulder (13) and the annular flange (14) is molded concentrically to the pouring spout (15) onto the shoulder (13) and forms with the pouring spout (15) an annular recess (25) for accommodating the at least one latching lug (22) of the screw cap (20).

8. A closure according to claim 2, wherein the at least one latching lug (22) extends over a portion of a circumference of the cap side wall (21) and is radially deflectable.

* * * * *